US005416259A

United States Patent [19]

Darnell et al.

[11] Patent Number: 5,416,259

[45] Date of Patent: May 16, 1995

[54] FEED PRETREATMENT FOR PERVAPORATION PROCESS

[75] Inventors: Charles P. Darnell, Baton Rouge, La.; Tan J. Chen, Kingwood; Enrique F. Juarez, Coppell, both of Tex.

[73] Assignee: Exxon Research & Engineering Co., Florham Park, N.J.

[21] Appl. No.: 125,044

[22] Filed: Sep. 21, 1993

[51] Int. Cl.[6] ..... C07C 7/00; C07C 7/144; C07C 7/12

[52] U.S. Cl. ..... 585/804; 585/819; 585/823

[58] Field of Search ..... 585/804, 819, 823

[56] References Cited

U.S. PATENT DOCUMENTS

| | | | |
|---|---|---|---|
| 2,007,114 | 7/1935 | Stratford | 196/13 |
| 2,084,510 | 6/1937 | Showalter | 196/1 |
| 2,789,081 | 4/1957 | Mills | 196/36 |
| 3,529,944 | 9/1970 | Leas | 44/70 |
| 3,671,423 | 6/1972 | MacDonald et al. | 208/97 |
| 3,684,684 | 8/1972 | Coleman et al. | 208/28 |
| 3,810,950 | 5/1974 | Woodle | 260/667 |
| 3,853,749 | 12/1974 | Espenscheid et al. | 208/307 |
| 4,502,948 | 3/1985 | Tabler | 208/183 |
| 4,561,967 | 12/1985 | Miller | 208/120 |
| 4,719,007 | 1/1988 | Johnson et al. | 208/251 |
| 4,770,763 | 9/1988 | Kusayanagi et al. | 208/18 |
| 4,795,545 | 1/1989 | Schmidt | 208/91 |
| 4,925,459 | 5/1990 | Rojey et al. | 155/16 |
| 4,925,562 | 5/1990 | te Hennepe et al. | 210/500.25 |
| 5,095,171 | 3/1992 | Feimer et al. | 585/819 |
| 5,207,894 | 5/1993 | Presnall et al. | 208/299 |

*Primary Examiner*—Anthony McFarlane
*Assistant Examiner*—Nhat D. Phau
*Attorney, Agent, or Firm*—Joseph J. Allocca

[57] ABSTRACT

The pervaporative treatment of hydrocarbon feeds which have been exposed to air or oxygen and which contain mixtures of aromatic and non-aromatic hydrocarbons to selectively separate the feed into an aromatics rich stream and a non-aromatics rich stream is improved by the step of pretreating the hydrocarbon feed over an adsorbent such as attapulgite clay.

7 Claims, 2 Drawing Sheets

FEED PRETREATMENT FOR PERVAPORATION PROCESS

FIELD OF THE INVENTION

This invention relates to a method for improving the performance of pervaporative separation of hydrocarbon feeds containing mixtures of aromatics and non-aromatics, which feed has been exposed to air or oxygen.

BACKGROUND OF THE INVENTION

It has been found that the performance of the pervaporative separation of hydrocarbon feeds containing mixtures of aromatics and non-aromatics is highly dependent on the oxygen content of the hydrocarbon feed.

U.S. Pat. No. 5,095,171 teaches that the separation of aromatic hydrocarbons from mixtures of aromatic and non-aromatic hydrocarbon feeds under pervaporation conditions is improved by the control of the amount of oxygen present in the feed. The amount of oxygen in the feed, such as heavy cat naphtha or other cracked feed, should be less than 50 wppm, preferably less than 10 wppm. The oxygen level in the feed is controlled by preventing exposure of the feed to air or oxygen, or, in the case of a feed which is already contaminated with oxygen, by addition to the feed of an oxygen scavenger or inhibitor. Oxygen scavengers or inhibitors are selected from the group consisting of hindered phenols, hindered amines and mixtures thereof.

The procedure of U.S. Pat. No. 5,095,171 while useful is hindered by the disadvantage of the need for segregated, oxygen free tankage and piping, which is expensive and may not always be available. Further, maintaining a continuous oxygen free environment over the feed may not be possible. Minor air leakages can create significant process problems during subsequent pervaporation. In such instances the oxygen scavenger or inhibitor can be used but their use should be kept to a minimum as their long term effects on the membranes used in the pervaporation process has not been established.

It is desirable therefore to identify alternate ways for reducing the oxygen content of hydrocarbon feeds containing mixtures of aromatic and non-aromatic components which are subjected to the pervaporative separation of the components present in the feed.

SUMMARY OF THE INVENTION

Figure 1:
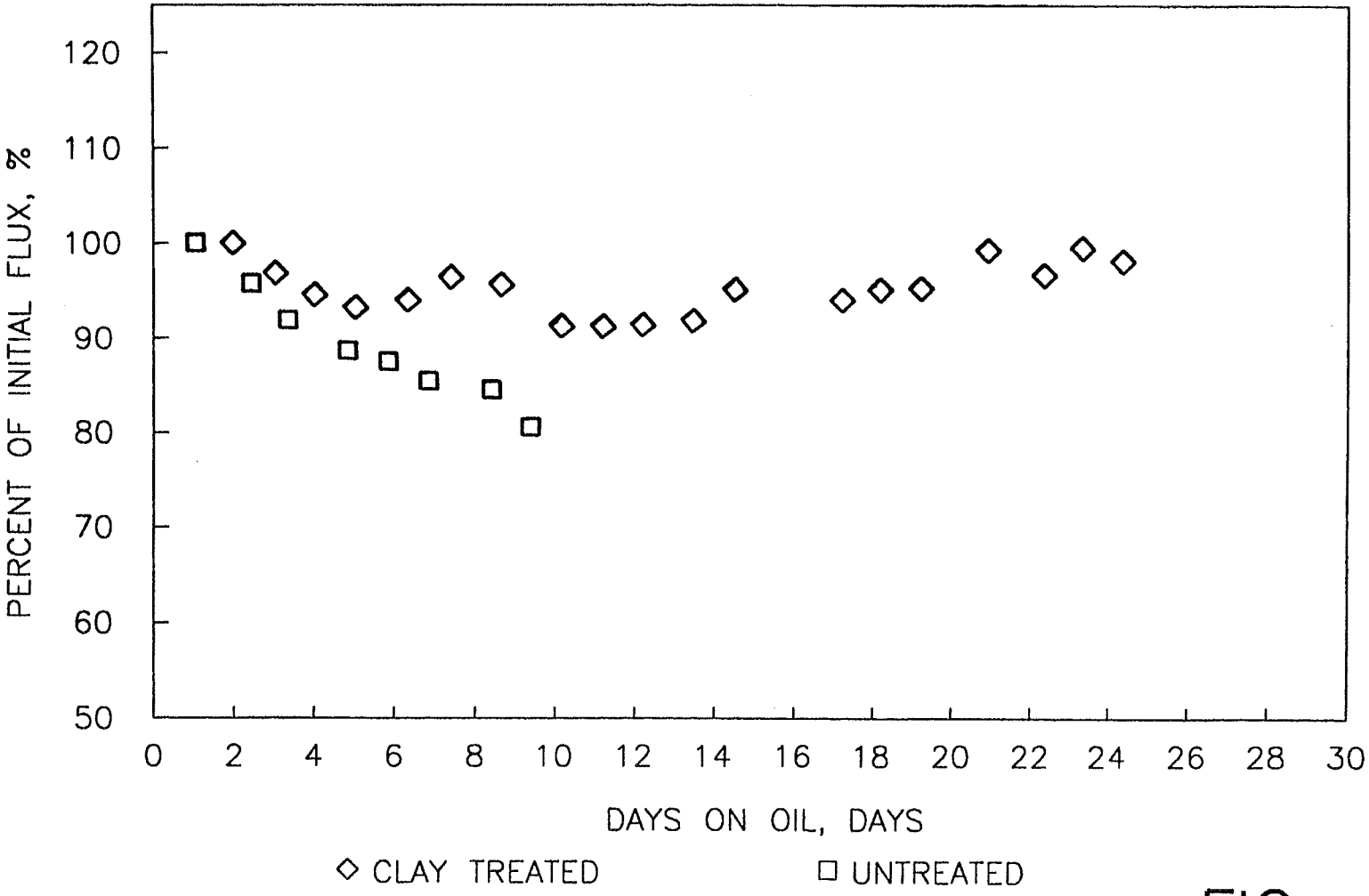
FIG. 1 compares percent of initial flux vs day on feed for two samples of feed, one clay treated the other untreated.

The present invention is directed to a method for preventing or minimizing flux decline of a membrane pervaporation separation process performed on oxygen exposed hydrocarbon feeds containing mixtures of aromatics and non-aromatics to produce aromatics rich-/nonaromatics lean permeate and aromatics lean/non-aromatics rich retentate, the method comprising subjecting the oxygen exposed hydrocarbon feeds to a pretreatment adsorption step involving contacting said feed with an adsorbent prior to the membrane pervaporation process.

The aromatics containing hydrocarbon feed which is subjected to this adsorptive pretreatment can be any aromatics containing hydrocarbon including heavy cat naphtha, intermediate cat naphtha, light cat naphtha, reformate, cracked jet or diesel stocks, cracked chemicals feed stocks containing aromatics, etc.

In general, the aromatics containing feed stock which is benefitted by the adsorption treatment of the present invention is any aromatics containing stock boiling generally in the range of about 65° F. to 1050° F. (about 18.3° to 565.6° C.) which picks-up oxygen upon standing or being exposed to air or an oxygen containing environment, preferably catalytically treated or catalytically or thermally cracked feed stocks.

If the feed stream is first subjected to deliberate oxygen injection the adsorbent pretreatment of the present invention should be practiced to lower the oxygen content prior to membrane separation. The Merox process is an example of a process which deliberately injects oxygen into the hydrocarbon. The Merox process is a method for reducing the mercaptan content of the hydrocarbon by injecting $O_2$ into the stream in the presence of a caustic to convert the mercaptans into di sulfides. For cracked feeds which have high dissolved oxygen contents (in excess of about 50 wppm) the oxygen content can be lowered by distillation, or by nitrogen or fuel gas purging prior to the adsorption pretreatment.

Permeate which has been exposed to air or oxygen either as tankage storage or as a result of air/oxygen intrusion from the vacuum system can also be subjected to this adsorption pretreatment prior to any permeate recycle step which may be practiced.

The oxygen containing/exposed feed is contacted with the adsorbent under any of the techniques known to the industry. Thus contacting can be under continuous or batch conditions. Continuous conditions can include up flow or down flow passage through a bed of adsorbent, percolation through a bed under the influence of a flow of inert gas, etc.

The contacting of the oxygen exposed/containing feed with the adsorbent is conducted at any convenient temperature, typically ambient to under the boiling point of the feed. Practice of the contacting at the elevated temperature is contemplated when dealing with the heavier stocks so as to improve fluidity. Any pressure may be employed.

The duration of contacting between the feed and the adsorbent is for a period sufficient to remove any products formed from the oxidation of cracked feed stocks containing aromatics.

Contacting can be for a period ranging from seconds to days, e.g., 1 minute to 5 days, preferably 60 minutes to 3 days.

Prior to contacting with the adsorbent the feed may be deaerated to reduce the oxygen content of the feed. Deaeration can be accomplished by bubbling an inert gas such as nitrogen through the feed.

The adsorbent used is a clay or other polar adsorbent which has an affinity for products formed from oxidation of cracked stocks.

The adsorbents are characterized by their cation—exchange capacity. It is preferred to have adsorbents having cation—exchange capacity of at least about 5 meq/100 g of dry adsorbents. Adsorbents include attapulgite clay, alumina, charcoal.

The adsorbents are preferably in finely divided form so as to present the highest adsorbent surface area. The preferred adsorbent particle size is between about 10–300 mesh (US). Finer grades can also be used. However, pressure drop across packed beds of finer grades of adsorbent particles would be considerably higher than that across a bed of 10–300 mesh particles.

Treatment of the feed with the adsorbent results in the pervaporation process exhibiting a high degree of flux maintenance over an extended period.

In pervaporation the feed is in either the liquid or vapor state. The process relies on vacuum or sweep gas on the permeate side to evaporate or otherwise remove the permeate from the surface of the membrane. Pervaporation process can be performed at a temperature of from about 25° to 200° C. and higher, the maximum temperature being that temperature at which the membrane is physically damaged.

The pervaporation process also generally relies on vacuum on the permeate side to evaporate the permeate from the surface of the membrane and maintain the concentration gradient driving force which drives the separation process. The maximum temperature employed in pervaporation will be that necessary to vaporize the components in the feed which one desires to selectively permeate through the membrane while still being below the temperature at which the membrane is physically damaged. While a vacuum may be pulled on the permeate side operation at atmospheric pressure on the permeate side is also possible and economically preferable. In pervaporation it is important that the permeate evaporate from the downstream side (permeate side) of the membrane. This can be accomplished by either decreasing the permeate pressure (i.e. pulling a vacuum) if the permeate boiling point is higher than the membrane operating temperature or by increasing the membrane operating temperature above the boiling point of the permeate in which case the permeate side of the membrane can be at atmospheric pressure. This second option is possible when one uses a membrane capable of functioning at very high temperature. In some cases if the membrane operating temperature is greater than the boiling point of the permeate the permeate side pressure can be greater than 1 atmosphere. The stream containing the permeate is cooled to condense out the permeated product. Condensation temperature should be below the dew point of the permeate at a given pressure level.

The membranes can be used in any convenient form such as sheets, tubes or hollow fibers. Sheets can be used to fabricate spiral wound modules familiar to those skilled in the art.

An improved spiral wound element is disclosed in copending application U.S. Ser. No. 921,872 filed Jul. 29, 1992 wherein one or more layers of material are used as the feed spacer, said material having an open cross-sectional area of at least 30 to 70% and wherein at least three layers of material are used to produce the permeate spacer characterized in that the outer permeate spacer layers are support layers of a fine mesh material having an open cross-sectional area of about 10 to 50% and a coarse layer having an open cross-sectional area of about 50 to 90% is interposed between the aforesaid fine outer layers. Wherein the fine layers are the layers in interface contact with the membrane layers enclosing the permeate spacer. While the permeate spacer comprises at least 3 layers, preferably 5 to 7 layers of alternating fine and coarse materials are used, fine layers always being the outer layers. In a further improvement an additional woven or non-woven chemically and thermally inert sheet may be interposed between the membrane and the multi-layer spacers, said sheet being for example a sheet of Nomex about 1 to 15 mils thick.

Alternatively, sheets can be used to fabricate a flat stack permeator comprising a multitude of membrane layers alternately separated by feed-retentate spacers and permeate spacers. The layers are glued along their edges to define separate feed-retentate zones and permeate zones. This device is described and claimed in U.S. Pat. No. 5,104,532.

Tubes can be used in the form of multi-leaf modules wherein each tube is flattened and placed in parallel with other flattened tubes. Internally each tube contains a spacer. Adjacent pairs of flattened tubes are separated by layers of spacer material. The flattened tubes with positioned spacer material is fitted into a pressure resistant housing equipped with fluid entrance and exit means. The ends of the tubes are clamped to create separate interior and exterior zones relative to the tubes in the housing. Apparatus of this type is described and claimed in U.S. Pat. No. 4,761,229.

Hollow fibers can be employed in bundled arrays potted at either end to form tube sheets and fitted into a pressure vessel thereby isolating the insides of the tubes from the outsides of the tubes. Apparatus of this type are known in the art. A modification of the standard design involves dividing the hollow fiber bundle into separate zones by use of baffles which redirect fluid flow on the tube side of the bundle and prevent fluid channelling and polarization on the tube side. This modification is disclosed and claimed in U.S. Ser. No. 423,178 filed Oct. 18, 1989.

Preferably the direction of flow in a hollow fiber element will be counter-current rather than co-current or even transverse. Such counter-current flow can be achieved by wrapping the hollow fiber bundle in a spiral wrap of flow-impeding material. This spiral wrap extends from a central mandrel at the center of the bundle and spirals outward to the outer periphery of the bundle. The spiral wrap contains holes along the top and bottom ends whereby fluid entering the bundle for tube side flow at one end is partitioned by passage through the holes and forced to flow parallel to the hollow fiber down the channel created by the spiral wrap. This flow direction is counter-current to the direction of flow inside the hollow fiber. At the bottom of the channels the fluid re-emerges from the hollow fiber bundle through the holes at the opposite end of the spiral wrap and is directed out of the module. This device is disclosed and claimed in copending application U.S. Ser. No. 802,158, filed Dec. 4, 1991, now U.S. Pat. No. 5,234,591.

The membranes employed in the present invention are generally described as polyester imide membranes and are described and claimed in U.S. Pat. No. 4,944,880 and U.S. Pat. No. 4,990,275.

The polyester imide membranes are made from a copolymer comprising a polyimide segment and an oligomeric aliphatic polyester segment, the polyimide being derived from a dianhydride having between 8 and 20 carbons and a diamine having between 2 and 30 carbons and the oligomeric aliphatic polyester being a polyadipate, a polysuccinate, a polymalonate, a polyoxalate or a polyglutarate. Alternately, an activated anhydride acid such as terphthalic anhydride acid chloride may be used.

The diamines which can be used include phenylene diamine, methylene dianiline (MDA), methylene di-o-chloroaniline (MOCA), methylene bis (dichloroaniline) (tetrachloro MDA), methylene dicyclohexylamine ($H_{12}$-MDA), methylene dichlorocyclohexylamine ($H_{12}$MOCA), methylene bis (dichlorocyclohexylamine) (tetrachloro $H_{12}$MDA), 4,4'-(hexafluoroisopropylidene)-bisaniline (6F diamine), 3,3'-diaminophenyl sulfone (3,3' DAPSON), 4,4'-diaminophenyl sulfone (4,4' DAPSON), 4,4'-dimethyl-3,3'-diaminophenyl sulfone (4,4'-dimethyl-3,3' DAPSON), 2,4-diamino cumene, methyl bis(di-o-toluidine), oxydianiline (ODA), bisaniline A, bisaniline M, bisaniline P, thiodianiline, 2,2-bis[4-(4-aminophenoxy) phenyl] propane (BAPP), bis[4-(4-aminophenoxy phenyl) sulfone (BAPS), 4,4'-bis(4-aminophenoxy) biphenyl (BAPB), 1,4-bis(4-aminophenoxy) benzene (TPE-Q), and 1,3-bis(4-aminophenoxy) benzene (TPE-R).

The dianhydride is preferably an aromatic dianhydride and is most preferably selected from the group consisting of pyromellitic dianhydride, 3,3',4,4'-benzophenone tetracarboxylic dianhydride, 4,4'-(hexafluoroisopropylidene)- bis(phthalic anhydride), 4,4'-oxydiphthalic anhydride, diphenylsulfone-3,3',4,4'-tetracarboxylic dianhydride, and 3,3',4,4'-biphenyl-tetracarboxylic dianhydride.

Examples of preferred polyesters include polyethylene adipate and polyethylene succinate.

The polyesters used generally have molecular weights in the range of 500 to 4000, preferably 1000 to 2000.

In practice the membrane may be synthesized as follows. One mole of a polyester, e.g. polyadipate, polysuccinate, polyoxalate, polyglutarate or polymalonate, preferably polyethylene adipate or polyethylene succinate, is reacted with two moles of the dianhydride, e.g. pyromellitic dianhydride, to make a prepolymer in the endcapping step. One mole of this prepolymer is then reacted with one mole of diamine, e.g. methylene di-o-chloroaniline (MOCA) to make a copolymer. Finally, heating of the copolymer at 260°–300° C. for about ½ hour leads to the copolymer containing polyester and polyimide segments. The heating step converts the polyamic acid to the corresponding polyimide via imide ring closure with removal of water.

In the synthesis an aprotic solvent such as dimethylformamide (DMF) is used in the chain-extension step. DMF is a preferred solvent but other aprotic solvents are suitable and may be used. A concentrated solution of the polyamic acid/polyester copolymer in the solvent is obtained. This solution is used to cast the membrane. The solution is spread on a glass plate or a high temperature porous support backing, the layer thickness being adjusted by means of a casting knife. The membrane is first dried at room temperature to remove most of the solvent, then at 120° C. overnight. If the membrane is cast on a glass plate it is removed from the casting plate by soaking in water. If cast on a porous support backing it is left as is. Finally, heating the membrane at 300° C. for about 0.5 hours results in the formation of the polyimide. Obviously, heating to 300° C. requires that if a backing is used the backing be thermally stable, such as teflon, fiber glass, sintered metal or ceramic or high temperature polymer backing.

EXAMPLES

A quantity of heavy cat naphtha (HCN) was secured having the following analytic characteristics:

Density: 0.849 g/cc
Sulfur: 0.31 wt %
Aromatics: 61.9 wt %
Olefins: 18.3 wt %
Saturates: 19.8 wt %
Initial boiling point: 335° F. (168.3° C.)
Final boiling point: 465° F. (240.6° C.)

This was divided into two samples which were exposed to air during handling resulting in a sample oxygen content of 1.2 wppm.

Both samples were deaerated by bubbling nitrogen into each sample for a period of 8 hours which reduced the oxygen level down to 0.1 wppm.

One deaerated sample was subjected to adsorbent pretreatment by being run over attapulgite clay at ambient temperature for seventy-two hours on a continuous basis at 400 cc/min. Eight hundred grams of clay were used to pretreat fifty gallons of this sample.

Both samples were independently pervaporated through a polyester imide membrane.

The polyester (adipate) imide membrane was prepared by first endcapping one part of 2000 molecular weight polyethylene adipate (PEA) with 2 parts of pyrometallic anhydride (PMDA) and then reacting one part of the endcapped polymer with methylene dianiline to form a polyamic acid. The polyamic acid was then coated onto a 0.1 micron pore size Gore teflon sheet with polyethylene terephthalate (PET) support (K-150). The viscosity of the polyamic acid was in the range of 90–150 cps at room temperature. Curing for the coating was nominally 260° C. for 11 minutes.

Pervaporation was conducted at 140° C., 10 psig feed pressure, and 10 mm Hg permeate pressure.

The results are presented graphically in the Figures.

Figure 2:
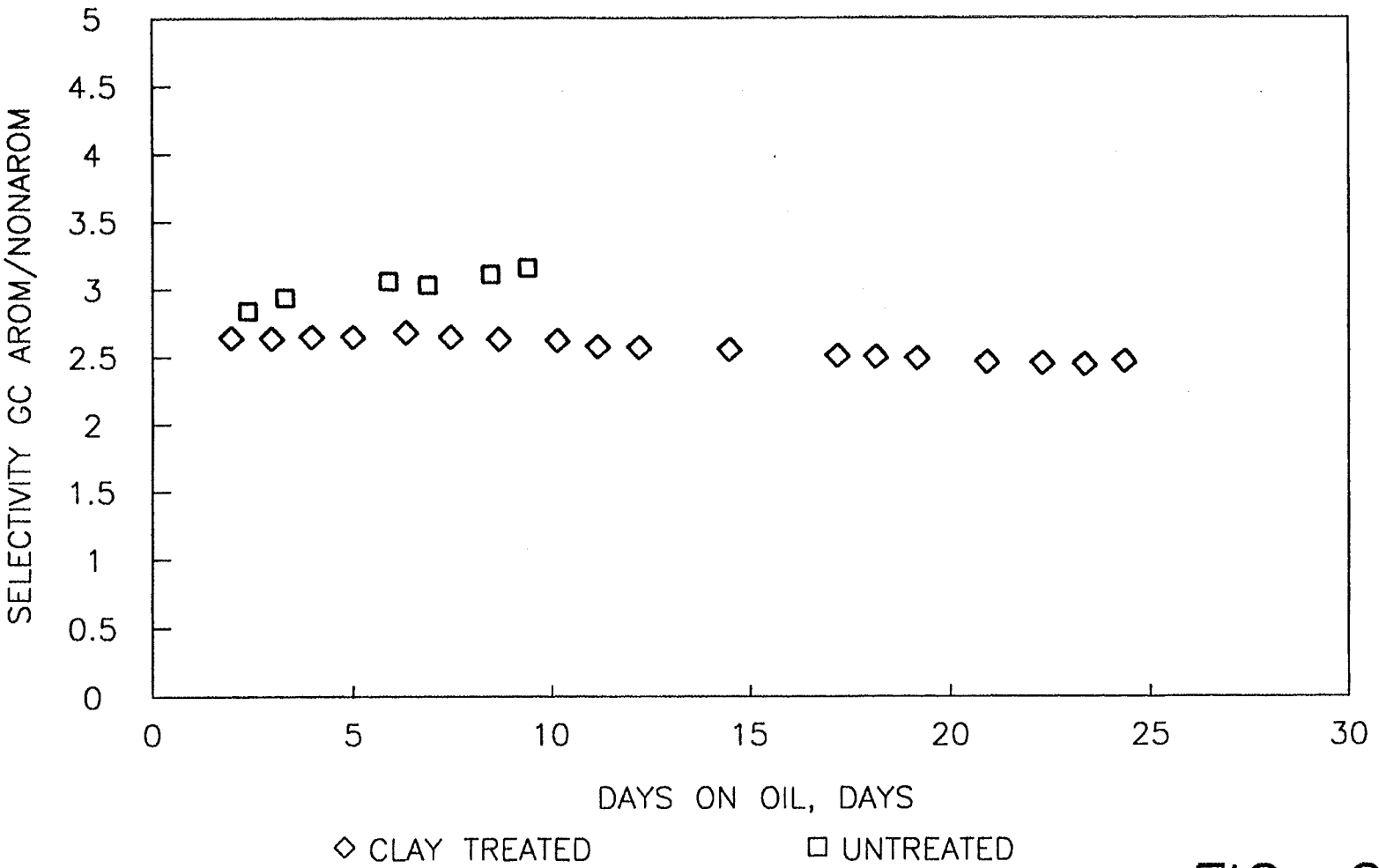
FIG. 2 compares the selectivity aromatics/non-aromatics vs days on feed for two samples of feed, one clay treated the other untreated.

As can be seen from FIG. 1, in the case of the non-treated HCN, the flux of the PEI membrane declined rapidly. In nine days of operations with the non-treated HCN, the flux of the membrane dropped by 20%. This was in spite of the fact that the feed was totally deaerated prior to the run and the oxygen level of the feed was only 0.1 wppm. FIG. 2 shows that the selectivity went up with time for the non-treated sample. The increase is attributable to the fact the membrane was fouled by the products from the oxidation reactions by the less stable components in the feed.

After the run with the non-clay treated HCN feed was completed, a run was then made with the clay-treated HCN. As can be seen from FIG. 1, over the twenty-four days that the membrane was tested with the clay-treated feed, there was no decline whatsoever in the membrane flux. However, as seen in FIG. 2, there was a small loss in membrane aromatics/non-aromatics selectivity with time. The slight loss is believed to be due to membrane equilibration.

The invention disclosed herein provides a method by which it is possible to get stable pervaporation performance with pervaporation membrane with hydrocarbon feeds containing mixtures of aromatics and non-aromatics which had been exposed to oxygen. With this integrated adsorption-pervaporation process, it is now possible to process such feeds which have been under tankage storage.

What is claimed is:

1. A method for preventing or minimizing flux decline in membrane pervaporation separation of aromatics from feed streams containing mixtures of aromatic(s) and non-aromatic hydrocarbons which feed stream has been exposed to air, said method comprising contacting said feed stream with a polar adsorbent having a cation exchange capacity of at least about 5 meq/100 g of dry adsorbent prior to subjecting the feed to membrane pervaporation separation resulting in the pervaporation process employing said feed to exhibit a constant flux.

2. The method of claim 1 wherein the feed stream is a catalytically processed stream or a catalytically or thermally cracked stream.

3. The method of claim 2 wherein the catalytically processed stream or catalytically or thermally cracked stream boils in the range of about 65° to 1050° F.

4. The method of claim 1, 2 or 3 wherein the feed which was exposed to air or oxygen is deaerated prior to being contacted with the adsorbent.

5. The method of claim 4 wherein the adsorbent is selected from attapulgite clay, alumina and charcoal.

6. The method of claim 1 wherein the adsorbent has a particle size between about 10 to 300 mesh.

7. The method of claim 1, 2 or 3 wherein the contacting of the feed with the adsorbent is for a period of from 1 minute to 5 days.

* * * * *